United States Patent [19]

Child

[11] Patent Number: 4,907,693

[45] Date of Patent: Mar. 13, 1990

[54] CONVERTIBLE SHIPPING CARTON

[75] Inventor: Jack R. Child, Huntington Beach, Calif.

[73] Assignee: Paper Corporation of America, Wayne, Pa.

[21] Appl. No.: 365,377

[22] Filed: Jun. 13, 1989

[51] Int. Cl.[4] ..... B65D 5/52

[52] U.S. Cl. ..... 206/44 R; 206/44.11; 229/125.32; 229/125.28

[58] Field of Search ..... 206/44 R, 44.11, 44.12, 206/45.12, 634; 229/123, 125.01, 125.14, 125.37, 125.38, 125.28, 125.32, 921

[56] References Cited

U.S. PATENT DOCUMENTS

| | | | |
|---|---|---|---|
| 2,773,589 | 12/1956 | Hennessey | 206/44.11 |
| 3,729,091 | 4/1973 | Davis | 206/44.11 |
| 4,382,504 | 5/1983 | Vesborg | 229/123 |
| 4,635,795 | 1/1987 | DeFlander et al. | 206/44 R |
| 4,657,176 | 4/1987 | Matsubara | 229/125.14 |
| 4,687,094 | 8/1987 | Allsop et al. | 206/44 R |
| 4,697,699 | 10/1987 | Scheider | 206/44.11 |
| 4,825,624 | 5/1989 | Calcerano | 206/44 R |

FOREIGN PATENT DOCUMENTS

| | | | |
|---|---|---|---|
| 897974 | 7/1949 | Fed. Rep. of Germany | 229/125.01 |
| 7510957 | 3/1976 | Netherlands | 229/125.01 |

*Primary Examiner*—David T. Fidei
*Attorney, Agent, or Firm*—Howson & Howson

[57] ABSTRACT

A shipping carton convertible into a bulk display bin by removing a panel insert. In one embodiment, the carton comprises a rectangular enclosure with lids extending from the front and back panels to close the bottom. Dust flaps extending from the side panels are spaced from one of the front panels to provide a recess for securing the insert in facing contiguity therewith. The top of the carton is closed by lids extending from the back panel and the insert. In another embodiment, a slot is provided in one of the side panel flaps for also securing the insert in facing contiguity with the associated side panel.

11 Claims, 4 Drawing Sheets

CONVERTIBLE SHIPPING CARTON

BACKGROUND OF THE INVENTION

The present invention relates to paperboard boxes, and more particularly to shipping cartons convertible into bulk display bins.

The packaging of an item of merchandise is often a significant part of the total unit cost of the item, especially when they are relatively small and inexpensive. Many "do-it-yourself" electrical, plumbing and hardware items, for example, are individually fastened or encapsulated on a card and hung on a hook for display and self-service in retail home centers. Unpackaged articles, on the other hand, are usually shipped in bulk to the retailers in sealed regular slotted cartons where they may be removed either to storage bins or display shelves.

The growing demand among consumers for "no-frills" merchandise has placed increased emphasis on eliminating expensive packaging and on selling in bulk with savings passed on to the consumer. The retailers simply leave the merchandise in the original folded shipping carton which is improvised into an open bulk display bin accessible to the customer by cutting off portions of the top and sides of the carton with a sharp blade. This, however, adds to the retailers' labor costs and risks injury to both the person cutting the carton and to the merchandise within the carton. Moreover, not all cartons are suited for such improvisation.

SUMMARY OF THE INVENTION

Accordingly, it is an object of the present invention to provide a folded shipping carton which can be readily converted into a display bin, and which is particularly suitable for shipping and displaying unpackaged or bulk articles.

Another object of the invention is to provide a convertible shipping carton which is sturdy and pilfer resistant, and which can be economically produced in many sizes and configurations.

Yet another object is to provide a shipping carton which is convertible into a bulk display bin with a billboard, which is safe to open and reconfigure as a display bin without cutting the carton, and which can accommodate many article sizes and configurations.

Briefly, these and other objects of the invention are accomplished by a folded shipping carton having a removable panel. The carton comprises a flat elongate sheet folded into a generally rectangular enclosure of front, back and side panels. In one embodiment, top and bottom dust flaps extending from the side panels fold inwardly; and top and bottom lids extending from the back panel, and a bottom lid extending from the front panel, fold inwardly over the top and bottom flaps with the bottom lids meeting midway between the front and back panels to close the bottom of the carton. A separate removable insert includes a rectangular section in facing contiguity with the interior surface of the front panel which extends down past adjacent recessed edges of the bottom flaps to abut the front bottom lid. The insert also includes a lid folded inwardly over the top flaps and meets the back top lid midway between the front and back panels to close the top of the carton. The lids are held closed by tape bonded to the outer surfaces to form a shipping carton. The carton can be converted into a display bin by cutting or removing the tape from the top lids, removing the insert, and unfolding the top flaps and top lid into the plane of their respective panels. In another embodiment, the insert includes front and side sections in facing contiguity with the interior surfaces of the respective front and side panels. The front section interlocks with recessed front edges of the bottom flaps, and a tab in the side section interlocks with a slot in the bottom flap. The interior surface of the top lid and a top flap when unfolded into a display bin configuration provide prominent areas for disclosing product information and price.

BRIEF DESCRIPTION OF THE DRAWINGS

Other objects, advantages and novel features of the invention will be readily apparent to those skilled in the art from the following detailed description considered in conjunction with the accompanying drawings wherein.

DESCRIPTION OF THE PREFERRED EMBODIMENTS

Figure 1:
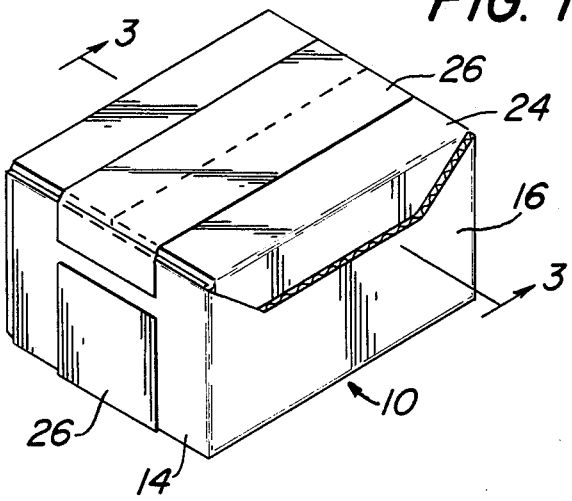
FIG. 1 is an isometric view of a convertible shipping carton according to one embodiment of the invention.

Referring now to the drawings wherein like characters designate like or corresponding parts throughout the several views, there is shown in FIGS. 1–5 a shipping carton 10 of flat elongate paperboard 12, transversely corrugated with ridges and grooves and equally slotted on opposite edges along four spaced transverse lines or scores a, b, c and d, respectively. Paperboard 12 is folded 90° in the same direction at the scores defining thereby a rectangular enclosure with side panels 14 and 18, front and back panels 16 and 20, and a tab 22 which underlaps and is bonded to the free end of side panel 14. Panels 14 and 18 are also folded inwardly 90° between the slots along parallel longitudinal scores e and f to form top and bottom dust flaps **14*a*, 14*b*, 18*a* and 18*b*. Panels 16 and 20 are similarly folded along scores e and f to form bottom lid 16*a* and top and bottom lids 20*a* and 20*b*. Lid 20*a* overlaps flaps 14*a* and 18*a* and extends halfway between front and back panels 16 and 20, and lids 16*b* and 20*b* overlap flaps 14*b* and 18*b* and meet midway between front and back panels 16 and 20. Top and bottom flanges 22*a* and 22*b* of tab 22 are bonded to top and bottom flaps 14*a* and 14*b*** for added strength to the carton.

The front edges of bottom flaps **14*b* and 18*b* have recesses 14*c* and 18*c* spaced from the interior surface of front panel 16 a distance equal to the thickness of a removable paperboard 24 which folds at score g collinear with score e to form a front panel 24*a* and a top lid 24*b*. Panel 24*a* is in facing contiguity with the interior surface of panel 16 with the bottom margin inserted between recesses 14c and 18c and front panel 16. Top lid 24b overlaps top dust flaps 14a and 18a meeting top lid 20a midway between front and back panels 16 and 20 for closing the top of the carton. Panel 24a is preferably corrugated in the same direction as front panel 16 to resist being pushed in when the bottom margin is tucked into recesses 14c and 18c**.

Carton 10 is sealed with an adhesive tape 26 bonded to side panels 14 and 18 and along the adjacent margins of top lids 20a, 24b and bottom lids 16b, 20b, respectively.

The top edge 17 of panel 16 is indented below score e to provide frontal visibility and easy access to the interior of carton 10 when it is transformed into a display bin. Also, front edges 15 of top flaps 14a and 18a are slanted from front panel 16 to provide lateral visibility when unfolded into the planes of their respective panels.

Figure 6:
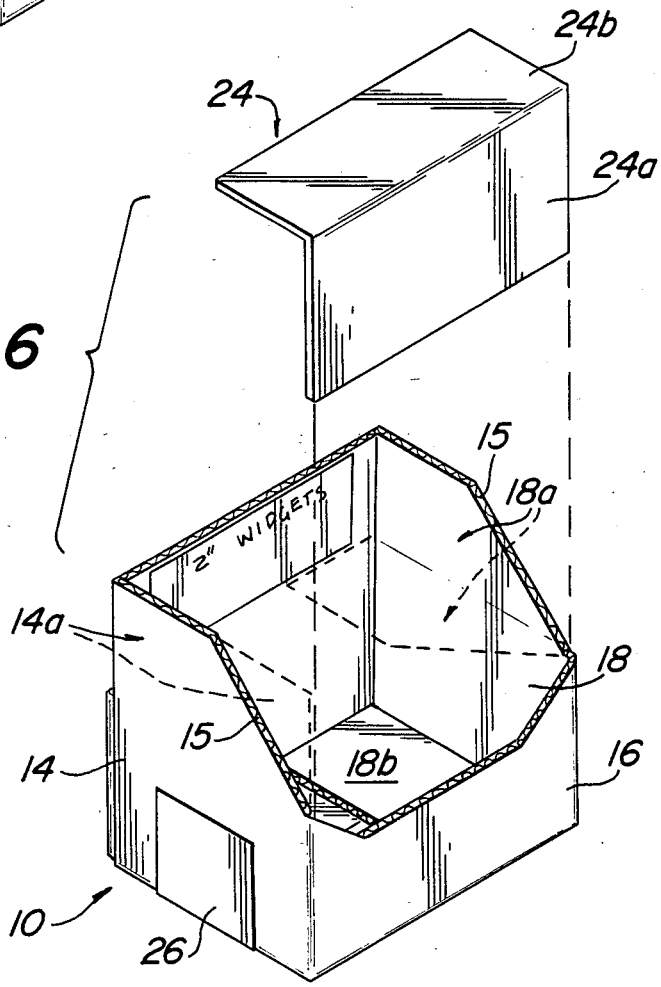
FIG. 6 is an isometric view of the carton of FIG. 1 transformed into a display bin.
Figure 2:
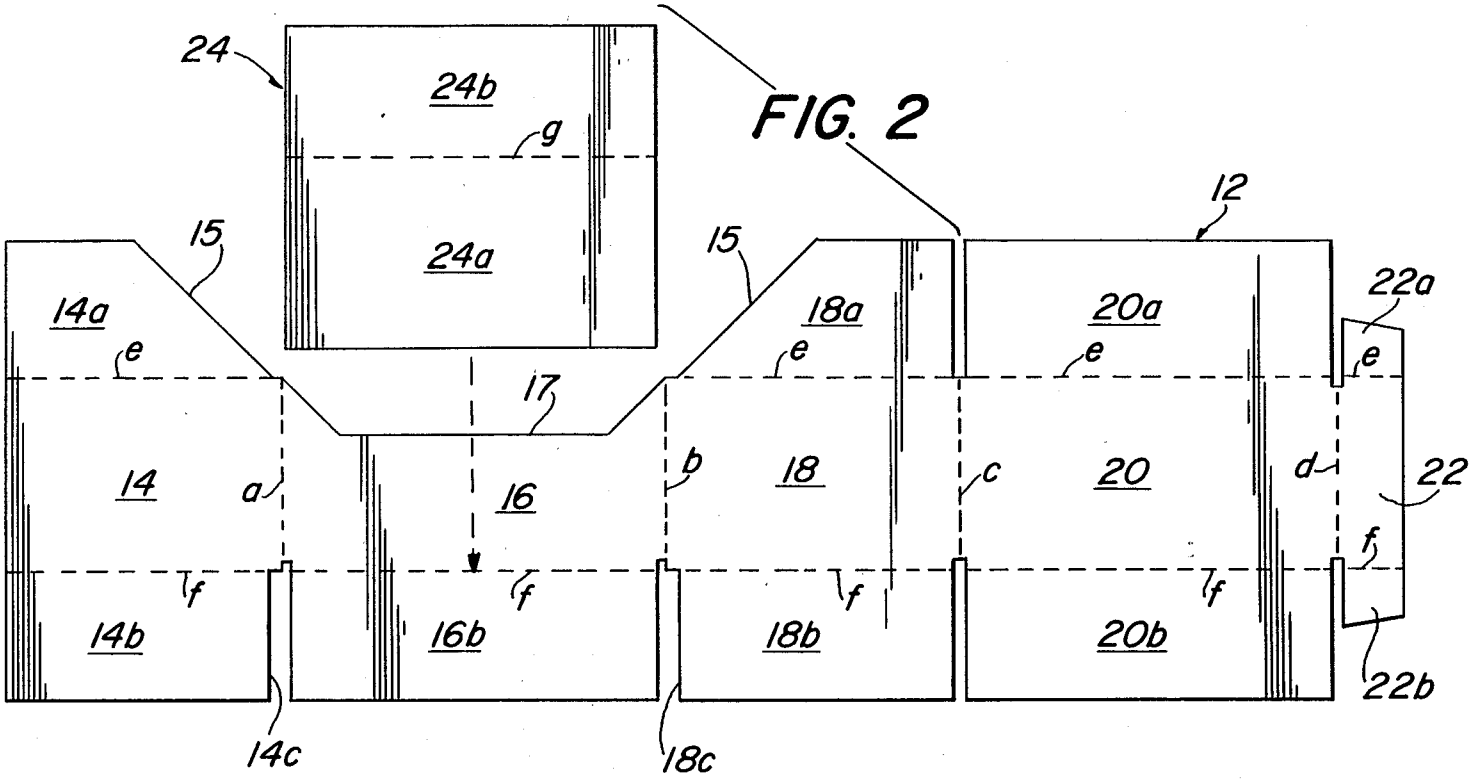
FIG. 2 is a disassembled and outspread view of cardboard components of the carton of FIG. 1.
Figure 3:
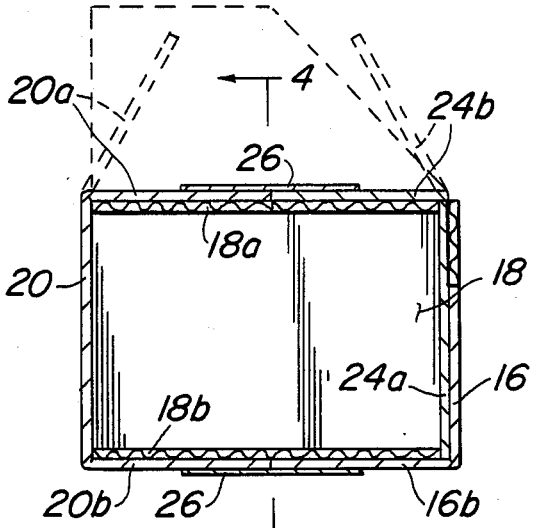
FIG. 3 is a view in transverse cross section of the carton taken along the line 3—3 of FIG. 1.
Figure 4:
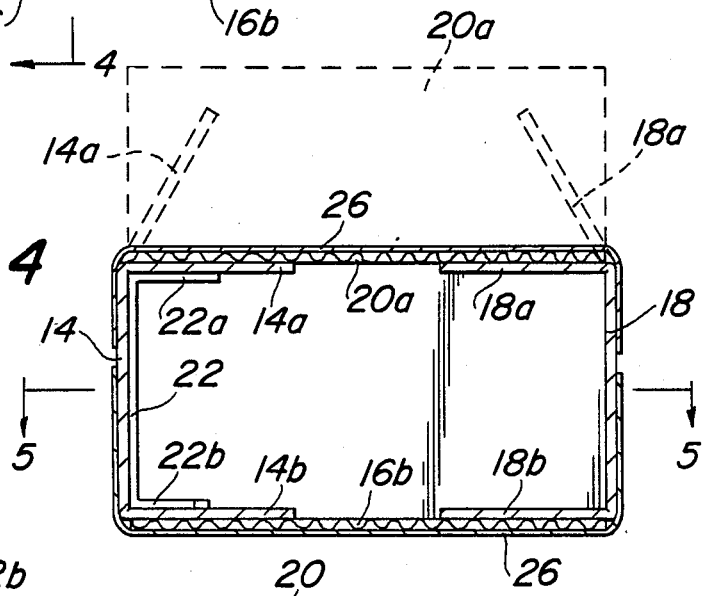
FIG. 4 is a view in transverse cross section of the carton taken along the line 4—4 of FIG. 3.
Figure 5:
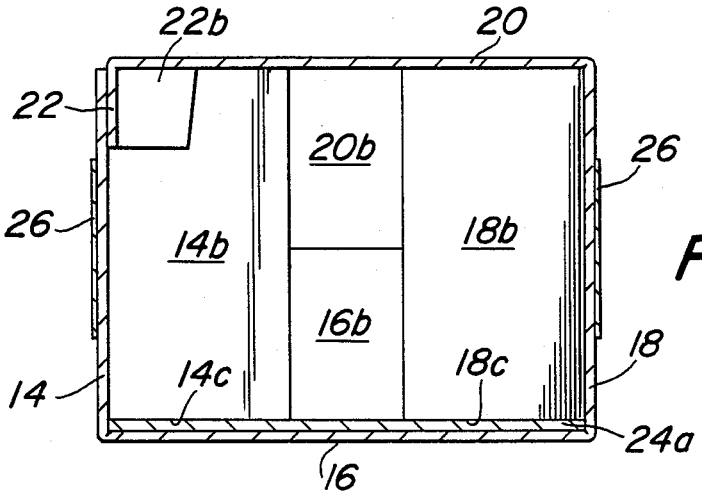
FIG. 5 is a view in transverse cross section of the carton taken along the line 5—5 of FIG. 4.

The conversion of carton 10 to a bulk display bin is illustrated in FIG. 6. Tape 26 has been removed, from top lids 20a and 24b, allowing paperboard 24 to be removed. Top lid 20a may be positioned in the plane of back panel 20, and top dust flaps 14a and 18a lifted into the planes of panels 14 and 18. Alternatively, flaps 14a and 18a may be left in the folded position as shown in dotted outline in FIG. 6. The interior surface of the top lid 20a thereby provides a billboard for disclosing product information and price of merchandise displayed within the bin.

Figure 8:
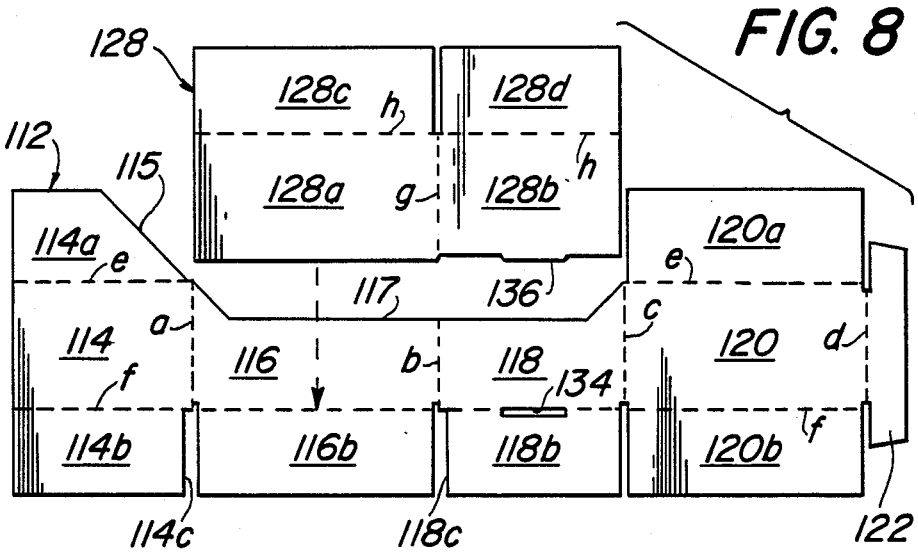
FIG. 8 is a disassembled and outspread view of cardboard components of the carton of FIG. 7.
Figure 7:
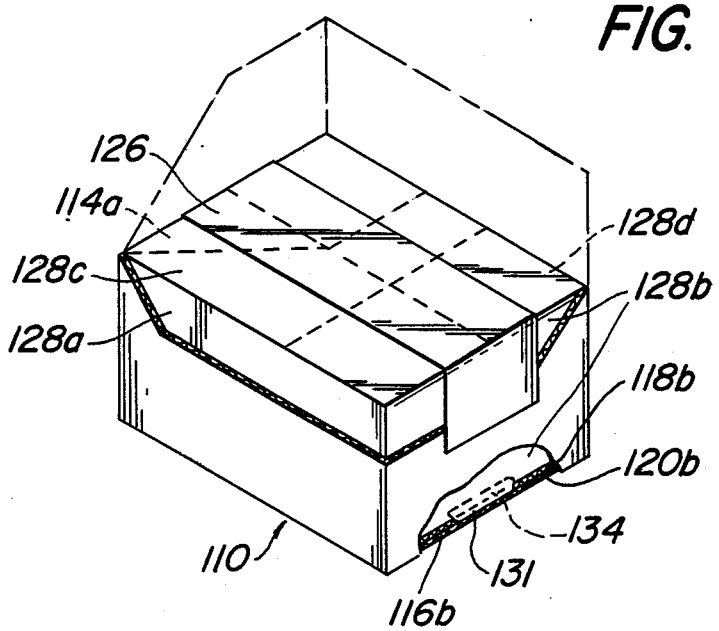
FIG. 7 is an isometric view of a convertible shipping carton according to another embodiment of the invention.

Shipping carton 110 in FIGS. 7 and 8 represents an alternate embodiment of the invention which permits the bin configuration to be accessible from two adjacent sides. In the manner described for the embodiment of FIG. 1, paperboard 112 is folded at scores a, b, c, and d into side panels 114 and 118, front and back panels 116 and 120, and underlapping tab 122. Panels 114 an 120 are folded at scores e and f to form top and bottom dust flaps 114a and 114b underlapping top and bottom lids 120a and 120b. Panels 116 and 118, on the other hand, are folded only at score f to form a bottom lid 116b overlapping a bottom dust flap 118b and dust flap 14b. The top edge 117 of panels 116 and 118 are indented below score e to permit access to the interior of carton 112 from either the front or side, and the front edge 115 of dust flap 114a is slanted from front panel 116 for lateral visibility.

A removable paperboard 128 folds 90° at score g, collinear with score b, to form front and side panels 128a and 128b in facing contiguity with the interior surfaces of front and side panels 116 and 118 respectively. Paperboard 128 is also folded inwardly at score h, coplanar with score e, to form a top lid 128c overlapping a top dust flap 128d and top dust flap 114a. Front edges 114c and 118c of bottom flaps 114b and 118b are recessed like edges 14c and 18c in carton 10 to secure the bottom margin of front panel 128a and to abut the bottom lid 116b. The bottom margin of side panel 128b, however, is recessed to form a tab 131 extending through a slot 134 and abutting bottom flap 116b. In this manner, both front and side panels 128a and 128b are braced against collapsing inward.

With the embodiment of FIGS. 7 and 8, it is possible to transform the shipping carton 110 into a display bin which can be oriented on shelves for easy access from either the front or side panels 116 and 118. When the shipping carton is ready for display, tape 126 is removed or cut to allow top flaps 114a and 120a to be unfolded and removable paperboard 128 discarded.

Some of the many advantages and novel features of the invention should now be readily apparent. For example, a carton is provided which is suitable for shipping bulk materials and which can be readily converted by a retailer into a storage bin where the merchandise is displayed for customer self-service. The carton is particularly suitable for shipping and displaying unpackaged or bulk articles. Its design lends itself to sturdy construction and pilfer resistance, and to economically manufacture in large quantities, many sizes and configurations.

It will be understood that various changes in the details, steps, and arrangement of parts, which have been herein described and illustrated in order to explain the nature of the invention, may be made by those skilled in the art within the principle and scope of the invention as expressed in the appended claims.

I claim:

1. A shipping carton suitable for converting into a display bin, comprising, in combination:

first and second pairs of opposed panels connected to form a generally rectangular enclosure;

bottom flaps foldable inwardly from respective bottoms of said first panels and recessed along one side normal to the foldline to form a first slot with the inner surface of one of said second panels;

bottom lids foldable inwardly from respective bottoms of said second panels against the outer surfaces of said bottom flaps for closure of the bottom of the enclosure;

a first top flap foldable inwardly from the top of one of said first panels;

a top lid foldable inwardly from the top of the other of said second panels against the outer surface of said first top flap; and a removable insert having a first member disposed for facing contiguity with said one of said second panels and for tucking the bottom edge into said first slot, and a second member foldable inwardly from the top of said first member against the outer surface of said first top flap for closure of the top of the enclosure with said top lid;

whereby removing said insert and unfolding said top lid into the plane of the other of said second panels transforms the shipping carton into a display bin.

2. A carton according to claim 1 further comprising:

a second top flap foldable inwardly from the top of the other of said first panels.

3. A carton according to claim 2 wherein:

said one of said second panels is indented along the top thereof for access from one side when the carton is transformed into a display bin.

4. A carton according to claim 1 wherein:

said bottom flap foldable from the other of said first panels includes a second slot along the foldline; and said insert includes a third member disposed for facing contiguity with the other of said first panels and for tucking the bottom edge into said second slot, and a fourth member foldable inwardly from the top of said third member against the inner surfaces of said second member and said top lid.

5. A carton according to claim 4 wherein:

said one of said second panels and said other of said first panels are indented along the tops thereof for access from adjacent sides when the carton is transformed into a display bin.

6. A convertible carton comprising:

rectangular enclosure means having front, back and side panels, a bottom panel, and a lid foldable inwardly from the top of said back panel;

insert means including a first member disposed for facing contiguity with said front panel and a second member foldable inwardly from the top of said first member for closure with said lid; and first retainer means disposed in said bottom panel for slidably receiving the bottom of said first member therein and for securing said first member against said front panel.

7. A convertible carton according to claim 6 wherein:

said front panel is indented along the top for access from the front of said enclosure.

8. A convertible carton according to claim 6 wherein:

said insert means further includes a third member disposed for facing contiguity with one of said side panels and a fourth member foldable inwardly against the inner surfaces of said second member and said lid; and second retainer means in said bottom panel for tucking the bottom of said third member therein and against said one side panel.

9. A convertible carton according to claim 8 wherein:

said one side panel is indented along the top for access from the corresponding sides of the carton when said insert means is removed.

10. A shipping carton suitable for converting into a display bin, comprising in combination:

front, rear and side panels forming a generally rectangular enclosure, said side panels each having a flap foldable inwardly from lower foldlines and one of said side panels having a flap foldable inwardly from an upper foldline, said rear panel having lids foldable inwardly from upper and lower foldlines, said front panel having a lid foldable inwardly from a lower foldline for closure with said lower rear lid, and said lower side flaps being recessed along the edges adjacent to said front panel thereby forming a first slot between said front panel and said recessed edges; and a removable panel having a first member conforming to the height and width of said front panel for tucking the lower edge into said first slot and a second member foldable inwardly against the outer surface of said one upper side flap for closure with said upper rear lid.

11. A carton according to claim 10 wherein:

one of said lower flaps includes a second slot along the foldline; and said removable panel includes a third member conforming to the height and width of the other of said side panels and a tab for tucking into said second slot for maintaining said third member against the other side panel, and a fourth member foldable inwardly against the inner surfaces of said second member of said lid.

* * * * *